US006840739B2

(12) United States Patent
Cortez et al.

(10) Patent No.: US 6,840,739 B2
(45) Date of Patent: Jan. 11, 2005

(54) CEILING FAN

(75) Inventors: Edward E. Cortez, Bartlett, TN (US); Patrick D. Szlachtowski, Cordova, TN (US); James P. Burns, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/357,831

(22) Filed: Feb. 4, 2003

(65) Prior Publication Data

US 2004/0151589 A1 Aug. 5, 2004

(51) Int. Cl.[7] ..... F04D 29/34
(52) U.S. Cl. ..... 416/210 R; 416/214 R
(58) Field of Search ..... 416/5, 210 R, 416/204 R, 205, 206, 207, 214 R, 220 A, 221

(56) References Cited

U.S. PATENT DOCUMENTS

| | | | | |
|---|---|---|---|---|
| 5,304,037 A | * | 4/1994 | Scofield | 416/210 R |
| 5,486,094 A | * | 1/1996 | Davis et al. | 416/210 R |
| 5,722,814 A | * | 3/1998 | Yu | 416/204 R |
| 6,010,306 A | | 1/2000 | Bucher et al. | |
| 6,039,540 A | * | 3/2000 | Wu | 416/210 R |
| 6,171,059 B1 | | 1/2001 | Bucher et al. | |
| 6,309,183 B1 | | 10/2001 | Bucher et al. | |
| 6,336,792 B1 | | 1/2002 | Bucher et al. | |

FOREIGN PATENT DOCUMENTS

| | | | | |
|---|---|---|---|---|
| JP | 62-218694 A | * | 9/1987 | 416/5 |

* cited by examiner

*Primary Examiner*—Christopher Verdier
(74) *Attorney, Agent, or Firm*—Baker Donelson

(57) ABSTRACT

A ceiling fan (10) is provided having a motor (12), a motor housing (13), fan blades (14), and blade irons (16) coupled to the motor and blades. Each blade iron includes a mounting arm (18), a mounting plate (19) and a decorative medallion (20). The mounting arm has a blade attachment portion (23) which has a decorative end (24) with mounting holes (25) therein. The blade iron mounting plate has a middle portion (31) straddled by a first end portion (32) and a second end portion (33). The middle portion and blade each have mounting holes (34) and (36), respectively, therein configured to conform with the mounting holes of the decorative end. The decorative medallion includes a cover plate (37) having a cavity (38) therein partially defined by an interior end wall (40) configured to mate with the first end portion (32) of the mounting plate. The medallion also includes two springs (43) configured to bias the cover plate away from the mounting plate and a set screw (45) mounted within a set screw mounting hole (46). The set screw is threadably movable between an unlocked position separated from the second end portion of the mounting plate and a locked position contacting and biasing against the second end portion.

11 Claims, 2 Drawing Sheets

CEILING FAN

TECHNICAL FIELD

This invention relates to ceiling fans, and specifically to the blade irons for ceiling fans.

BACKGROUND OF THE INVENTION

Ceiling fans having blade irons which couple the ceiling fan blades to the ceiling fan electric motor have existed for many years. Typically, these blade irons are mounted to the underside of the blade by mounting screws which extend from the topside of the blade, through mounting holes within the blade and into threaded mounting holes on the top side of the underlying blade iron. As most ceiling fans are only viewable from a position below the fan, this configuration allows the aesthetically pleasing blade iron to be viewable from below while the generally unattractive mounting screws are obstructed from view by the blades.

Today many houses are constructed with two story foyers and great rooms. As such, ceiling fans mounted in these areas of the house are often viewable from a position both below and above the ceiling fan. As such, conventional ceiling fans are undesirable in these locations as their aesthetically unpleasing topsides with the exposed mounting screws are viewable from a position above the ceiling fan.

Some ceiling fans today have blade irons which are mounted to the topside of the blade. These ceiling fans have their blade mounting screws passing from the topside of the blade iron through the blade iron and blade wherein they are threadably received within mounting holes within a decorative plate positioned upon the underside of the blade. As such, the blade is sandwiched between the blade iron and the decorative underlying plate. Here again however, the aesthetically unpleasing mounting screws are viewable from a position above the ceiling fan.

Accordingly, it is seen that a need remains for a ceiling fan which is aesthetically pleasing from a position both below and above the ceiling fan. It is to the provision of such therefore that the present invention is primarily directed.

SUMMARY OF THE INVENTION

In a preferred form of the invention a ceiling fan comprises a motor, a plurality of blade irons, each blade iron having a mounting portion coupled to the motor and a blade attachment portion opposite the mounting portion, a plurality of blades, wherein each blade is associated with one blade iron, a plurality of blade attachment means for attaching each blade to a blade iron, and a plurality of covering means for covering the plurality of blade attachment means. Each covering means includes a mounting plate having a middle portion straddled by first and second end portions, a cover plate having a cavity therein sized and shaped to receive at least a portion of the mounting plate, the cover plate having an interior end wall defining the cavity having a slope configured to mate with the first end portion of the mounting plate, and adjustable locking means for locking the cover plate to the mounting plate. The locking means is mounted to the cover plate and is adjustable between a locked position biasing against the second end portion of the mounting plate and an unlocked position removed from the second end portion of the mounting plate.

DETAILED DESCRIPTION

Figure 1:
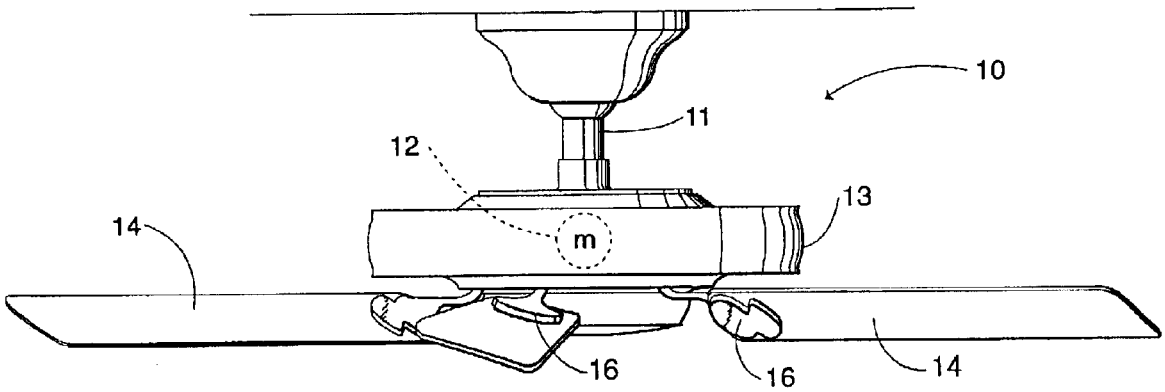
FIG. 1 is a side view of a ceiling fan embodying principles of the invention in a preferred form.
Figure 2:
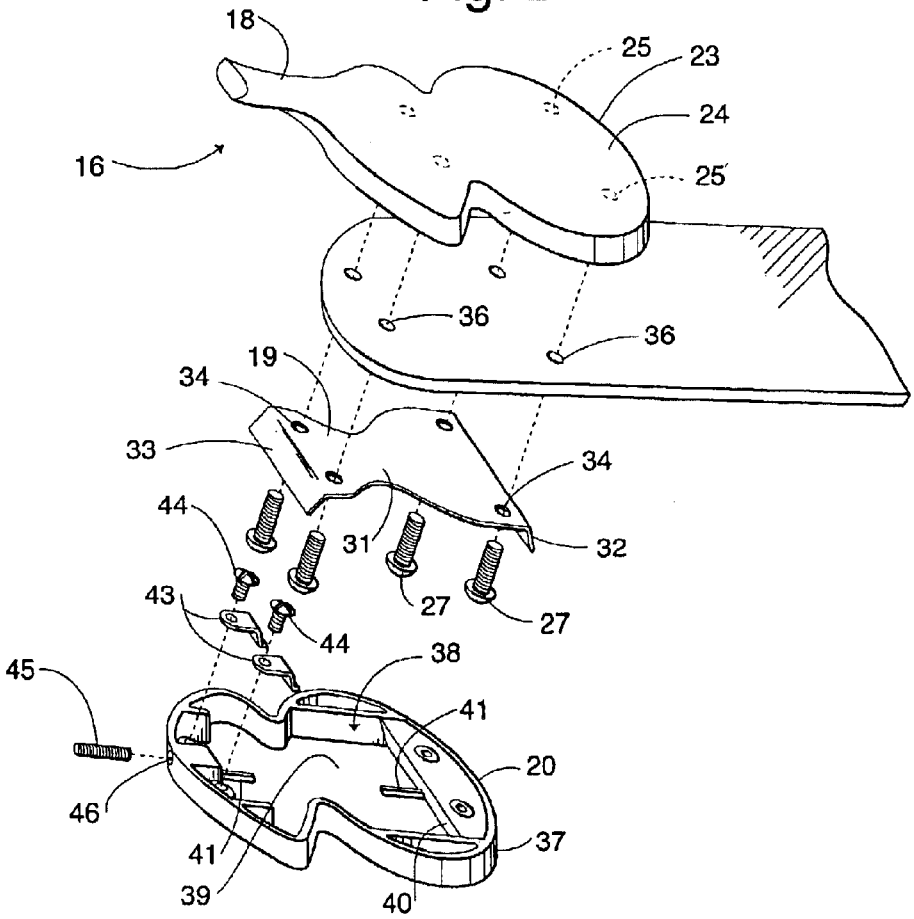
FIG. 2 is an exploded view of the ceiling fan blade iron and blade of FIG. 1.

With reference next to the drawings, there is shown a ceiling fan 10 in a preferred form of the invention. The ceiling fan 10 has a downrod 11 extending from a ceiling, a motor 12, a motor housing 13, fan blades 14, and blade irons 16. The ceiling fan motor 12 extends through an opening at the lower end of the motor housing 13. The ceiling fan blades 14 are coupled to blade irons 16 which are in turn coupled to the motor 12 at pre-determined locations depending on the desired number of fan blades 14. Any number of fan blades 14 may be used as dictated by convention. Thus, rotational motion produced by the motor will produce air circulation through rotational movement of the fan blades 14. In order to control the speed of rotation of the fan blades 14, the motor has an unshown control switch which can be controlled conventionally through actuation of an electrical controller.

Each blade iron 16 includes a mounting arm 18, a mounting plate 19 and a decorative medallion 20. The mounting arm 18 has a conventional mounting bracket coupled to the motor and a blade attachment portion 23 in the form of a decorative end 24 configured to be mounted flushly upon the topside of the blade 14. The decorative end 24 has four internally threaded mounting holes 25 therein configured to receive four threaded mounting screws 27.

The blade iron mounting plate 19 has a middle portion 31 straddled by a first, downturned, end portion 32 and a second, downturned, end portion 33. The first and second end portions 32 and 33 extend from the middle portion 31 at an angle diverging from each other. The middle portion 31 has four mounting holes 34 therein configured to conform with the mounting holes 25 of decorative end 24. Blade 14 also has four mounting holes 36 therein which also conform with mounting holes 25 of the decorative end 24.

Figure 3:
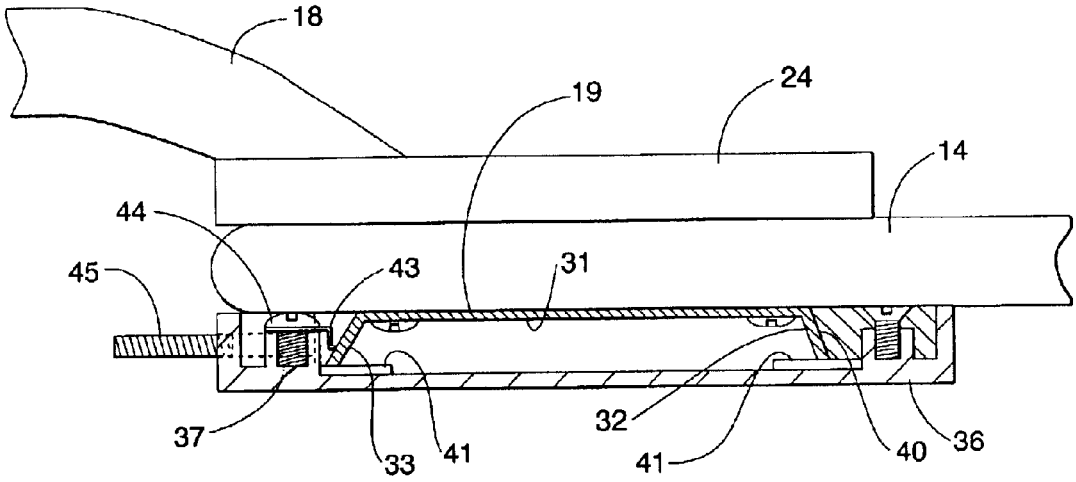
FIG. 3 is a side view, in partial cross-section, of the blade iron and blade of FIG. 1, shown in an unlocked configuration.
Figure 4:
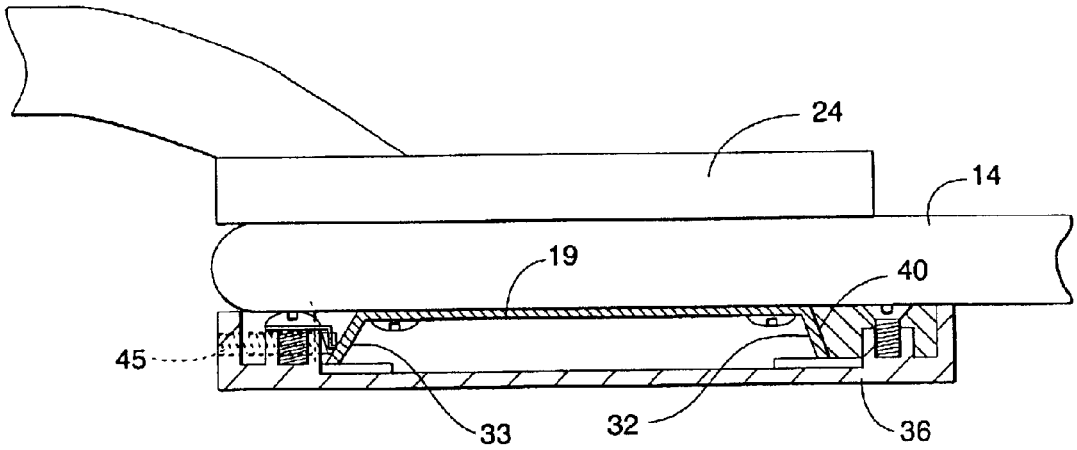
FIG. 4 is a side view, in partial cross-section, of the blade iron and blade of FIG. 1, shown in a locked configuration.

The decorative medallion 20 includes a cover plate 37 having a cavity 38 therein sized and shaped to receive the mounting plate 19. The medallion cavity 38 is partially defined by a floor 39 and an interior end wall 40 which is configured at an angle to mate with the first end portion 32 of the mounting plate 19. Although the end wall 40 shown herein comprises a portion of an insert mounted to the remaining portion of the cover plate, as an alternative, it may be incorporated directly into the form of the cover plate. The medallion 20 includes two oppositely disposed support ridges 41 extending from the floor 39 to increase the thickness of the medallion in the area in which the mounting plate 19 contacts the cover plate 37. The medallion 20 also includes two springs 43, mounted to cover plate 37 by mounting screws 44, configured to bias the cover plate 37 away from the mounting plate 19, and a set screw 45 mounted within a set screw mounting hole 46. The set screw 45 is threadably movable between a unlocked position removed or separated from the second end portion 33 of the mounting plate 19, as shown in FIG. 3, and a locked position contacting and biasing against the second end portion 33 of the mounting plate 19, as shown in FIG. 4.

In use, the four mounting screws 27 are passed through the mounting holes 34 in the mounting plate 19, through the mounting holes 36 in the blade 14, and threaded into the mounting holes 25 in the decorative end 24 of the mounting arm 18, thereby mounting the mounting plate 19 flushly against the underside of the blade 14 and the blade to the mounting arm 18. With the set screw 45 in its unlocked position, as shown in FIG. 3, the cover plate 37 is positioned over the mounting plate 19 with the first end portion 32 seated against the interior end wall 40. The cover plate 37 is then forced down against the biasing force of the springs 43 and the set screw 45 is threadably moved to its locked position, shown in FIG. 4. With the set screw 45 in its locked position the mounting plate 19 is captured securely between the interior end wall 40 and the set screw 45. The biasing force of the two springs 43 prevents the cover from vibrating as the biasing force of the springs opposes the biasing force of the set screw and also provides a secondary mounting force should set screw 45 be accidently disengaged. The ridges 41 aid in preventing the mounting plate from deforming the cover plate 37 should the set screw be overly tightened against the mounting plate, thereby causing the mounting plate to be forced against the cover plate.

It should be understood that as an alternative to the set screws 45 shown in the preferred embodiment other types of biasing means may be used to create a directional force between the cover plate 37 and the mounting plate 19, such as a sliding cam, a rotating cam, a spring or the like.

Also, it should be understood that as an alternative to the mounting screws 27 the blade iron may employ other types of locking mechanisms such as rotating clips, snaps or locks.

Also, it should be understood that the blade iron structure may be inverted, so that the mounting arm decorative end 24 is mounted upon the underside of the blade 14 while the medallion 20 is mounted to the topside of the blade 14.

Lastly, it should be understood that as an equivalence to the mounting plate shown in the preferred embodiment other mounting means may be utilized to couple the cover to the blade or blade attachment device. For example, the mounting may be accomplished through two separately mounted flanges instead of the unitary mounting plate of the preferred embodiment. Also, the mounting plate or alternatively flanges may be mounted to the blade separately from the means which mounts the blade to the blade iron.

It thus is seen that a ceiling fan is now provided with a blade iron which is aesthetically pleasing from a viewing position both below and above the ceiling fan. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A ceiling fan comprising, a motor;

a plurality of blade irons, each said blade iron having a mounting portion coupled to said motor and a blade attachment portion opposite said mounting portion;

a plurality of blades, each said blade being associated with one said blade iron of said plurality of blade irons;

a plurality of blade attachment means for attaching each blade of said plurality of blades to one said blade iron; and a plurality of covering means for covering said plurality of blade attachment means, each said covering means including a mounting plate having a middle portion straddled by first and second end portions angled from said middle portion, a covering plate having a cavity therein sized and shaped to receive at least a portion of said mounting plate, said cover plate having an interior end wall defining said cavity having a slope configured to mate with said first end portion of said mounting plate, and adjustable locking means for locking said cover plate to said mounting plate, said locking means being mounted to said cover plate and being adjustable between a locked position biasing against said second end portion of said mounting plate and un unlocked position removed from said second end portion of said mounting plate.

2. The ceiling fan of claim 1 wherein said locking means is a threaded set screw mounted within a threaded screw hole within said cover plate.

3. The ceiling fan of claim 1 wherein said cavity has a floor and wherein said cover plate has a safety ridge protruding from said floor positioned to abut one said end portion of said mounting plate.

4. The ceiling fan of claim 1 further comprising a spring for biasing said cover plate away from said mounting plate.

5. The ceiling fan of claim 1 wherein each said blade attachment means comprises a plurality of screws extending through said mounting plate and said blade and into said blade iron.

6. A ceiling fan blade iron for a ceiling fan having an electric motor rom which a plurality of blade irons extend to which are mounted ceiling fan blades, the blade iron comprising, a mounting arm mounted to said motor;

blade attachment means for attaching a blade to said mounting arm; and covering means for covering said blade attachment means, said covering means including a mounting plate having a middle portion straddled by first and second end portions, a cover plate having a cavity therein sized and shaped to receive at least a portion of said mounting plate, said cover plate having an interior end wall configured to mate with said first end portion of said mounting plate, and locking means for locking said cover plate to said mounting plate.

7. The ceiling fan blade iron of claim 6 wherein said locking means is mounted to said cover plate and is adjustable between a locked portion biasing against said second end portion of said mounting plate and an unlocked position removed from said second end portion of said mounting plate.

8. The ceiling fan blade iron of claim 7 wherein said locking means is a threaded set screw mounted within a threaded screw hole within said cover plate.

9. The ceiling fan blade iron of claim 6 wherein said cover plate cavity has a floor and wherein said cover plate has a safety ridge protruding from said floor positioned to abut one said end portion of said mounting plate.

10. The ceiling fan blade iron of claim 6 further comprising a spring for biasing said cover plate away from said mounting plate.

11. The ceiling fan blade iron of claim 6 wherein each said blade attachment means comprises a plurality of screws extending through said mounting plate and the blade and into said mounting arm.

* * * * *